United States Patent [19]

McCandless

[11] 4,176,432

[45] Dec. 4, 1979

[54] METHOD FOR ESTABLISHING UNIFORM CATHODE-TO-GRID SPACING IN AN ELECTRON GUN

[75] Inventor: Harry E. McCandless, Hopewell, N.J.

[73] Assignee: RCA Corporation, New York, N.Y.

[21] Appl. No.: 969,158

[22] Filed: Dec. 13, 1978

[51] Int. Cl.[2] ..... H01J 9/18

[52] U.S. Cl. ..... 29/25.16; 29/25.15

[58] Field of Search ..... 29/423, 25.15, 25.16

[56] References Cited

U.S. PATENT DOCUMENTS

| | | | |
|---|---|---|---|
| 3,130,474 | 4/1964 | Fiore | 29/423 |
| 3,340,035 | 9/1967 | Hajduk | 29/25.16 |
| 3,434,819 | 3/1969 | Merchant et al. | 29/25.16 |
| 3,533,147 | 10/1970 | Baur et al. | 29/25.15 |
| 3,643,121 | 2/1972 | Sawagata et al. | 29/25.15 |
| 3,667,224 | 6/1972 | Tsuneta et al. | 29/25.16 |
| 3,848,301 | 11/1974 | Gruber | 29/25.16 |
| 4,015,315 | 4/1977 | Stone | 29/25.16 |

*Primary Examiner*—John McQuade

*Attorney, Agent, or Firm*—Eugene M. Whitacre; Glenn H. Bruestle; Dennis H. Irlbeck

[57] ABSTRACT

Uniform cathode-to-grid spacing in an electron gun including a plurality of cathodes is provided by first, inserting a metal strip and a confronting plastic strip on the cathode side of a grid. The sum of the thicknesses of the two strips is the desired cathode-to-grid spacing. Next, the cathodes are moved until the cathodes press against one of the strips. The cathodes now are affixed relative to the grid. Thereafter, one of the strips not in contact with the cathodes is withdrawn. Finally, the other strip is withdrawn.

3 Claims, 1 Drawing Figure

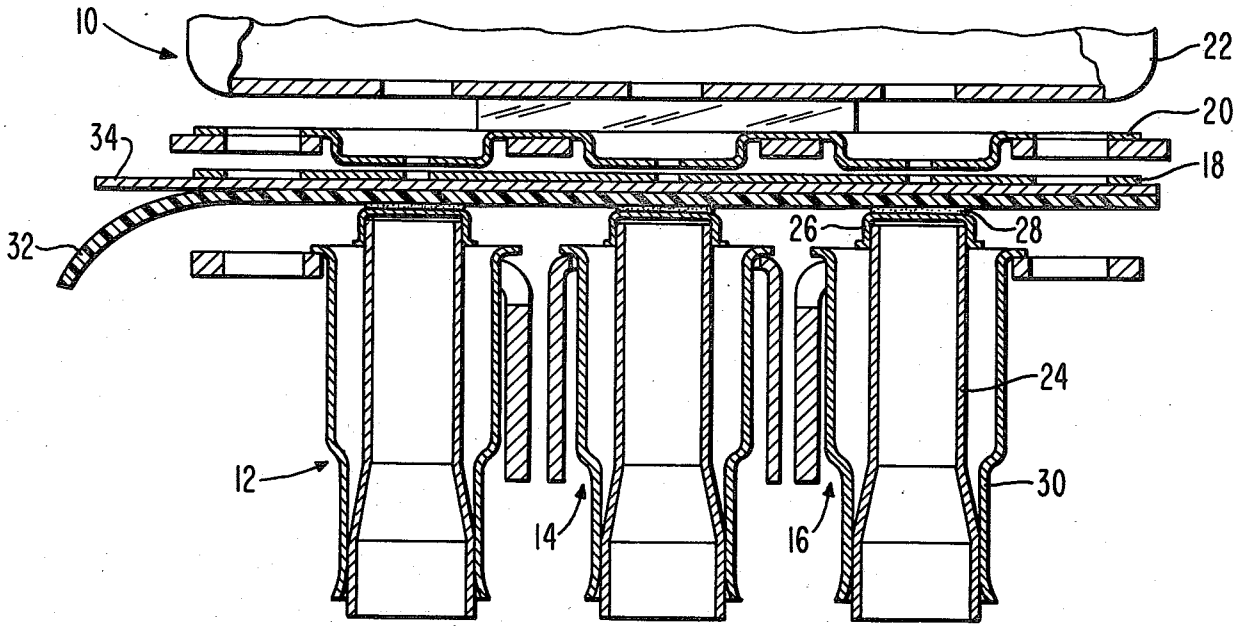
10
22
20
18
34
32
28
26
24
30
16
14
12

METHOD FOR ESTABLISHING UNIFORM CATHODE-TO-GRID SPACING IN AN ELECTRON GUN

BACKGROUND OF THE INVENTION

This invention relates to a method of spacing a cathode from a grid during electron gun construction and particularly to such method using contact spacing elements.

In an electron gun, the surface of the electron-emissive coating of a cathode is axially positioned relative to a control grid. The cathode and grid are fixed to, and electrically insulated from, one another by glass support rods. The electron gun also includes a cathode support and a screen grid which is spaced from the control grid. When the emissive surface of the cathode is positioned too close to the control grid, arcing between the cathode and the control grid may occur, and the cutoff voltage may change. A very small change in the spacing distance such as 0.001 inch (0.0254 mm), may change the cutoff voltage of the electron gun by about 60 volts.

There are several methods presently in use for establishing cathode-to-grid spacing. In the most common, an air probe is inserted through the grid apertures and the cathode is moved toward the probe until a predetermined backpressure, related to spacing, is measured. Similar methods utilize optical or microscopic measurements to set spacing. Other methods use a spacing element that is positioned in direct contact with the cathode and grid. In these later methods, either a mechanical spacer remains in the gun or the spacer is soluble or volatile and is thereafter removed by dissolution in water or by heat.

Cathode-grid spacings set by permanent spacers can vary from tube to tube due to parts and assembly tolerances. Gas flow gages require the insertion of a nozzle through the grid aperture which can damage that aperture. Optical measurements are too slow for production. Soluble or volatile spacers introduce materials that are difficult to remove completely and can either harm the emissive surface or deposit material on insulators thus causing electrical leakage between gun elements.

SUMMARY OF THE INVENTION

A method is provided for establishing uniform cathode-to-grid spacing in an electron gun having a plurality of cathodes. First, a substantially nondeformable strip and a confronting substantially deformable strip are inserted on the cathode side of a grid with the nondeformable strip facing the grid. The sum of the thicknesses of the two strips is the desired cathode-to-grid spacing. Next, the cathodes are moved until the cathodes press against the deformable strip. The cathodes now are affixed relative to the grid. Thereafter, the nondeformable strip is first withdrawn. Finally, the deformable strip is withdrawn.

BRIEF DESCRIPTION OF THE DRAWINGS

The single drawing is a sectional plan view of the beam forming region of a typical multibeam electron gun with spacer strips inserted between the cathodes and a grid.

DETAILED DESCRIPTION

Referring to the drawing, there is shown a portion of an electron gun assembly 10 of a type used in color television tubes. A complete gun of this type is described in U.S. Pat. No. 3,772,554 issued to R. H. Hughes on Nov. 13, 1973. The gun assembly 10 includes means for forming three inline electron beams. Three inline cathode assemblies 12, 14 and 16 are shown in spaced relationship to three unitized electrodes: a control grid 18, a screen grid 20 and a first focus electrode 22. Each cathode assembly comprises a cathode sleeve 24 closed at a forward end by a cap 26 having an electron emissive coating 28 thereon. The cathode sleeve 24 is supported by a tubular cathode eyelet 30. The three unitized electrodes 18, 20 and 22 each have three apertures therein which are aligned with the centers of the three caps 26. As previously mentioned, the spacing between the emissive coating 28 and the control grid 18 is very critical. During the cathode-to-control grid spacing procedure, the cathode sleeve 24 is free to slide within the eyelet 30. Once the desired cathode-to-grid spacing has been established, the sleeve 24 is welded to the eyelet 30.

The drawing shows two strips 32 and 34 inserted between the cathode cap 26 and the control grid 18. The strip 32 contacting the emissive coatings 28 of the cathodes is a plastic, such as Quick-Sol-P, a polymer based on ethylene-oxide manufactured by Polymer Films Incorporated. The strip 34 contacting the control grid 18 is a metal, such as copper-beryllium. This metal is of a type preferred since it can be used to form pieces which are easily photo-etched in large quantities. The sum of the thicknesses of the two strips 32 and 34 equals the desired cathode-to-grid spacing. For example, in an embodiment where the desired spacing is 0.0055 inch (0.1397 mm), the metal strip 34 can be 0.003 inch (0.0712 mm) thick and the plastic strip 32 can be 0.0025 inch (0.0635 mm) thick.

The novel cathode-to-grid spacing method begins by the placement of the two strips 32 and 34 between the control grid 18 and the cathode assemblies 12, 14 and 16 with the cathode sleeves positioned in a pulled-back position. Thereafter, the cathode sleeves are moved forward toward the control grid 18 until the emissive coatings 28 on the caps 26 strike the plastic strip 32. The plastic strip 32 is of a material which is soft enough to deform slightly as the emissive coatings 28 are pressed against it. Once the cathode caps 26 are in position against the plastic strip 32, the cathode sleeves 24 are affixed, such as by welding, to the eyelets 30. Now, the metal strip 34 first is removed from its position between the plastic strip 32 and the control grid 18 thus freeing the plastic strip 32 from the emissive coatings 28. Next, the plastic strip 32 is removed.

By following the foregoing procedure, a desirable direct contact spacing method is utilized wherein the emissive coatings on the cathodes are fully protected and each cathode of a plurality of cathodes are identically spaced from a particular electrode.

Although the preferred embodiment has been described with respect to the combination of a metal strip and a plastic strip for spacing purposes, it should be understood that other materials having the desired characteristics also may be used. For example, a substantially deformable material, such as the described plastic, is essential for contact with the emissive coating on the cathode so that the coating will not be cracked or chipped off by the spacing procedure. However, a substantially nondeformable material is required for the second strip so that it does not deform into the grid apertures thereby making removal difficult.

It should also be understood that although the word strip has been used herein, other flat shapes, such as sheets or plates, are also intended to be covered by the word strip. Furthermore, it should also be appreciated that a plurality of strips could be used to form each described strip to obtain specific spacings.

I claim:

1. A method for establishing uniform cathode-to-grid spacing in an electron gun including a plurality of cathodes, said method comprising the steps of:

inserting a substantially nondeformable strip and a confronting substantially deformable strip on the cathode side of a grid with the nondeformable strip facing the grid, the sum of the thicknesses of the two strips being the desired cathode-to-grid spacing, moving the cathodes until the cathodes press against the deformable strip, affixing the cathodes relative to the grid, first withdrawing the nondeformable strip and thereafter withdrawing the deformable strip.

2. A method for establishing uniform cathode-to-grid spacing in an electron gun including a plurality of cathodes, said method comprising the steps of:

inserting a metal strip and a confronting plastic strip on the cathode side of a grid with the metal strip facing the grid, the sum of the thicknesses of the two strips being the desired cathode-to-grid spacing, moving the cathodes until the cathodes press against the plastic strip, affixing the cathodes relative to the grid, first withdrawing the metal strip and thereafter withdrawing the plastic strip.

3. A method for establishing cathode-to-grid spacing in an electron gun including three inline cathodes supported respectively in three cathode supports, said method comprising the steps of:

inserting a metal strip and a confronting plastic strip on the cathode side of said grid with said metal strip contacting said grid, the sum of the thicknesses of said two strips being the desired cathode-to-grid spacing, moving said cathodes within the cathode supports until the cathodes press against said plastic strip, affixing said cathodes to said cathode supports, and withdrawing said metal strip and thereafter withdrawing said plastic strip.

* * * * *